United States Patent [19]

Sakamaki et al.

[11] Patent Number: 4,564,344

[45] Date of Patent: Jan. 14, 1986

[54] ROTARY COMPRESSOR HAVING ROTARY SLEEVE FOR ROTATION WITH VANES

[75] Inventors: Hiroshi Sakamaki, Utsunomiya; Susumu Sugishita, Hanyu; Yukio Horikoshi, Kazo, all of Japan

[73] Assignee: Nippon Piston Ring Co., Ltd., Tokyo, Japan

[21] Appl. No.: 559,805

[22] Filed: Dec. 9, 1983

[30] Foreign Application Priority Data

Dec. 11, 1982 [JP] Japan ..... 57-216294

[51] Int. Cl.[4] ..... F04C 18/348

[52] U.S. Cl. ..... 418/173

[58] Field of Search ..... 418/172, 173, 174, 270; 308/DIG. 1; 384/109; 432/132

[56] References Cited

U.S. PATENT DOCUMENTS 2,918,877 12/1959 Woodcock ..... 418/71

4,197,061 4/1980 Hill ..... 418/270

4,479,763 10/1984 Sakamaki et al. ..... 418/173

*Primary Examiner*—Leonard E. Smith

*Attorney, Agent, or Firm*—Birch, Stewart, Kolasch & Birch

[57] ABSTRACT

A rotary compressor with a center housing and a rotary sleeve mounted in the center housing for rotation with a plurality of vanes radially slidably fitted in a rotor which is eccentrically disposed in the rotary sleeve, and an air-bearing room defined between the outer periphery of the rotary sleeve and the inner periphery of the center housing to floatingly support the rotary sleeve, characterized in that a part of compressed air in the rotary compressor is injected into the air-bearing room through the throttles provided in the compression side wall of the center housing to prevent the rotary sleeve from scuffing the inner periphery of the center housing.

13 Claims, 9 Drawing Figures

ROTARY COMPRESSOR HAVING ROTARY SLEEVE FOR ROTATION WITH VANES

BACKGROUND OF THE INVENTION

1. Field of the Invention

The present invention relates to a rotary compressor that is provided with a rotary sleeve mounted in a center housing for rotation with a plurality of vanes radially slidably fitted in a rotor which is eccentrically disposed in the rotary sleeve and utilizable as a supercharger for a vehicle internal-combustion engine, and more particularly to an air-bearing room defined between the outer periphery of the rotary sleeve and the inner periphery of the center housing to floatingly support the rotary sleeve.

2. Description of the Prior Art

In Japanese Published Unexamined Patent Application No. 58-65988 published on Apr. 18, 1983, we have shown a rotary compressor provided with a rotary sleeve interposed between the center housing and the rotor and floatingly supported by compressible fluid. The compressor is particularly suitable for a supercharger with use for an automobile engine required to operate over a wide range of speeds. The rotary sleeve rotates together with the vanes to remove frictional heat as well as wear at the apex of each vane. However, there is the possibility of scuffing and seizing troubles if air is highly compressed in the compression working space confined among the rotary sleeve, the rotor, and the adjacent vanes to push the rotary sleeve from within to the inner periphery of the center housing.

SUMMARY OF THE INVENTION

The primary object of the invention is to provide a rotary compressor in which a rotary sleeve is mounted in a center housing for rotation with a plurality of vanes radially slidably fitted in a rotor which is eccentrically disposed in the rotary sleeve and prevented from scuffing the inner periphery of the center housing when it is put aside to the compression side inner periphery of the center housing by the high-pressure air in the compression working space.

To accomplish the object as described, the compressor of the invention comprising a rotary sleeve mounted in a center housing for rotation with a plurality of vanes radially slidably fitted in a rotor which is eccentrically disposed in the rotary sleeve, an air-bearing room defined between the outer periphery of the rotary sleeve and the inner periphery of the center housing, and discharge and suction chambers, is characterized in that the air-bearing room is supplied through the throttles provided in the compression side of the center housing with the air compressed in the compressor. The high-pressure air is led to a high-pressure passage in the compression side of the center housing through a high-pressure hole extending from the discharge chamber to the joining surfaces of the side and center housings, and a high-pressure groove extending along the joining surfaces to cross the high-pressure hole, and then injected into the air-bearing room through a plurality of throttles opened to the compression side inner periphery of the center housing from the high-pressure passage. The injected air in the compression side of the air-bearing room produces a static pressure to push back and prevent the rotary sleeve from contactng the inner periphery of the center housing. The air-bearing room is internally connected either to the atmospher through front and rear air-return grooves in the suction side inner surfaces of the front and rear side housings, an air-return passage passing through the center housing to cross the both air-return grooves, and a vent branched from the air-return passage to the atmosphere or to the suction chamber through a low-pressure hole formed in the side housing to connect the air-return passage to the suction chamber. The air rapidly flows from the compression side to the suction side of the air-bearing room and easily produces a dynamic pressure to floatingly support the rotary sleeve.

The other objects and advantages of the invention will become apparent from the following detailed description of the invention in conjunction with the attached drawings.

DESCRIPTION OF THE PREFERRED EMBODIMENTS

Figure 1:
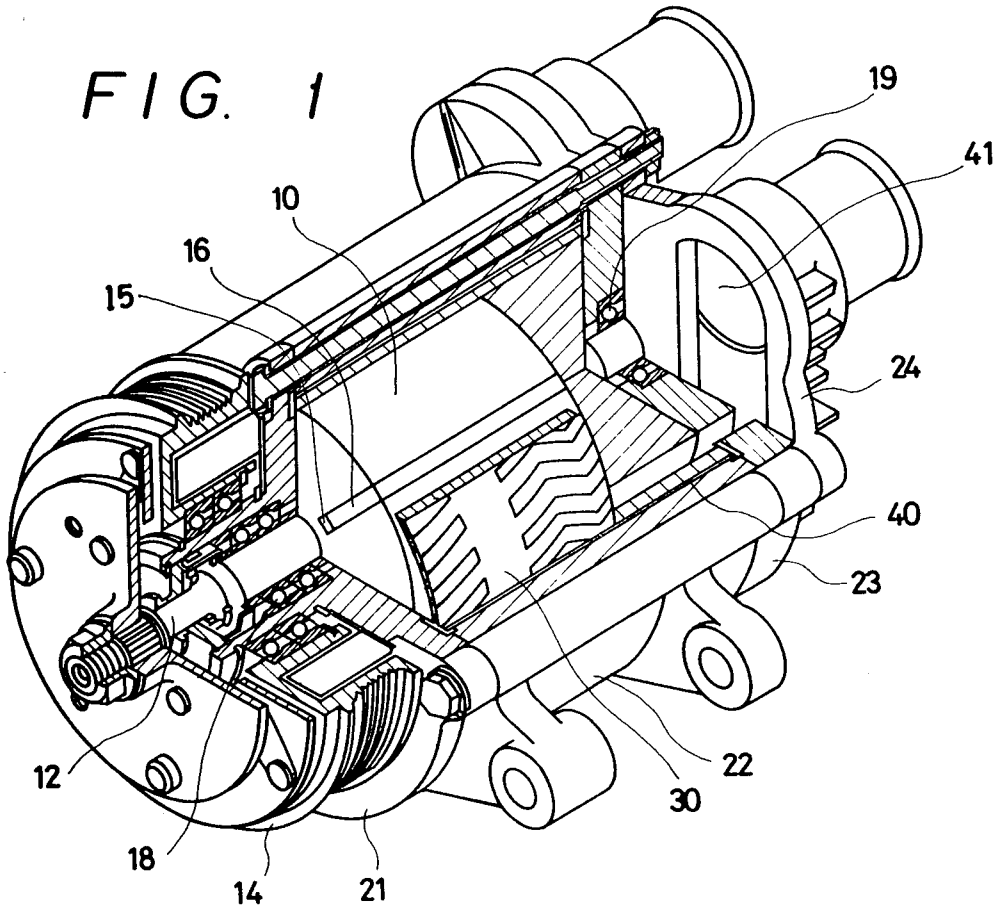
FIG. 1 is a pictorial view of an embodiment of the invention with a part broken away to reveal the inside of the rotary compressor.

The compressor of the present invention is described in detail below with reference to the drawings. Referring initially to FIG. 1, the compressor has a rotor 10 integrally provided with a rotary shaft 12, which is rotatably supported by bearings 18, 19 in the respective front and rear side housings 21, 23 and fixed at the front end thereof to a pulley 14 which is rotated by a non-illustrated engine. A plurality of vanes 16 are radially slidably fitted in the respective vane grooves in the rotor 10. The rotary sleeve 30 is mounted within the center housing 22 to define an air-bearing room 40 of 0.02–0.15 mm width therebetween. A gasket is interposed between the rear side housing 23 and the rear cover 24 in which the discharge chamber 41 and the suction chamber (not shown) are provided.

Figure 2:
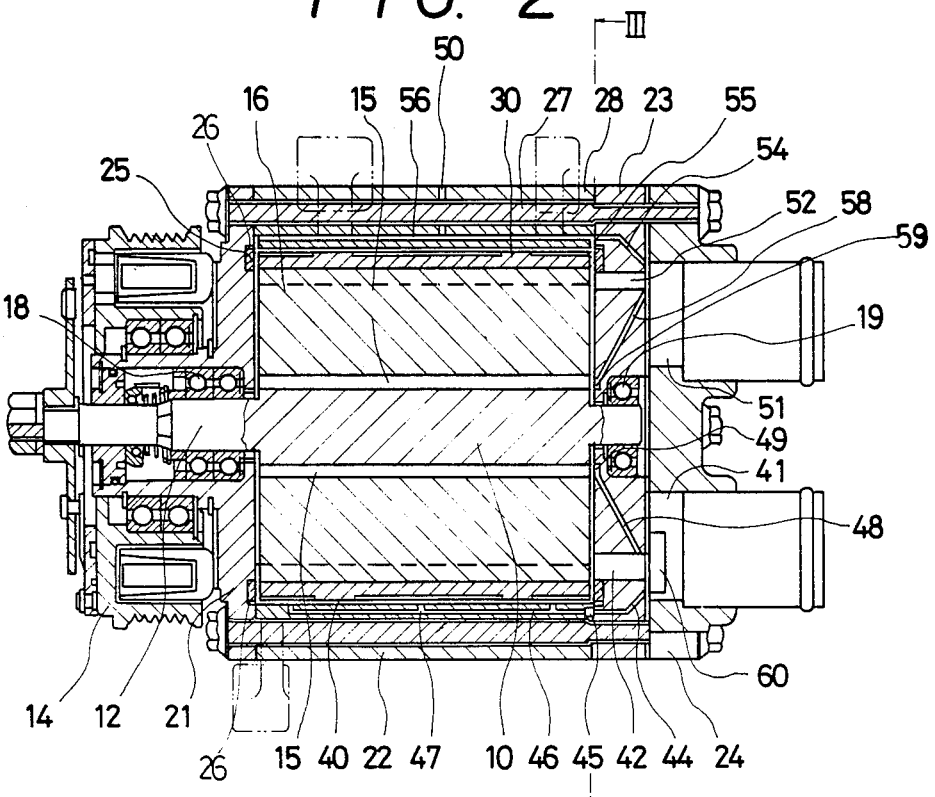
FIG. 2 is an axial section of the compressor of FIG. 1.
Figure 4:
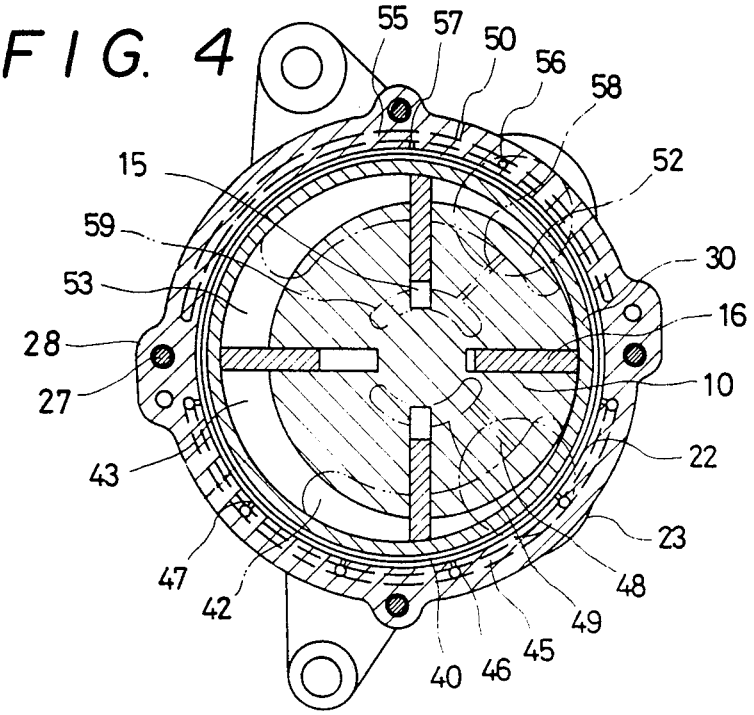
FIG. 4 is a somewhat enlarged cross-section of FIG. 1.

As seen in FIGS. 2 and 4, each vane 16 radially projects from the vane groove 16 and has its apex in contact with the inner periphery of the rotary sleeve 30. The discharge chamber 41 is internally connected to a discharge port 42 through a discharge valve 60 and the suction chamber 51 is internally connected to a suction port 52. Bolts 27 pass through the thick wall portions 28 of the center housing 22 to axially fasten the front and rear side housings 21, 23, the center housing 22 and the rear cover 24. The rear side housing 23 is formed with a high-pressure hole 44 extending from the discharge valve 60 to the joining surface between the center housing 22 and the rear side housing 23. The center housing 22 is formed on its rearside surface with a high-pressure groove 45 which forms a circular arc with a subtended angle less than 170 degrees to cross the high-pressure hole 44. The center housing 22 has a plurality of high-pressure passages 46 axially extending from the high-pressure groove 45. Each high-pressure passage 46 is provided with a plurality of throttles 47 opened to the compression side inner periphery of the center housing 22. Thus, the discharge chamber is internally connected to the air-bearing room 40. The discharge chamber 41 is also connected to the vane groove 15 through the intermediary of a high-pressure inner hole 48 extending from the discharge port 42 and crossing a high-pressure inner groove 49 while each vane 16 is in the compression side.

The suction chamber 51 in the rear cover 24 is internally connected to a rear low-pressure groove 55 in the center housing 22 through a low-pressure hole 54 in the rear side housing. An air-return passage 56 passes through the center housing 22 to connect the front and rear low-pressure grooves 55. The both low-pressure grooves 55 are symmetrically formed and connected to the air-bearing room 40 with the intervention of the front and rear air-return grooves 57 which extend radially from the air-bearing room 40 to the low-pressure groove 55. The air-return passage 56 is branched to the open air through a vent 50, in which a non-illustrated cheque valve is mounted. Thus, the air-bearing room 40 is internally connected to suction chamber 51 or the atmosphere. The suction chamber is also connected to the vane groove 15 in the suction side through a low-pressure inner hole 58 in the rear side housing 23 and a low-pressure inner groove 59. In the case of the compressor required to have a high compression ratio, the air-return passage and grooves 56, 57 and low-pressure hole and groove 54, 55 are eliminated.

As seen in FIG. 2, the bearings 18, 19 are contained in the front and rear side housings 21, 23 to support the rotary shaft 12 which is removably connected to the pulley 14 with the intervention of an electromagnetic clutch. Front and rear side housings 21, 23 have the inner surfaces formed with the annular grooves 26 in which oilless bearing memebers 25 are embedded for smooth contact with the side surfaces of the rotary sleeve 30.

Figure 3:
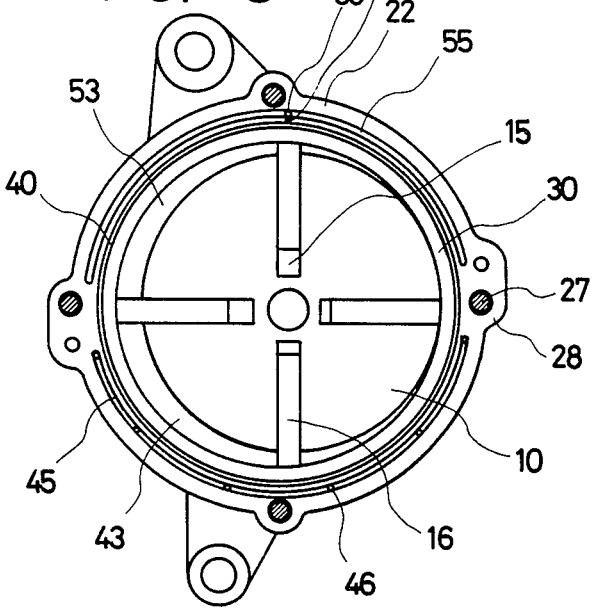
FIG. 3 is a section taken along the line III—III of FIG. 2.

As seen in FIG. 3, the high-pressure passage 46 are disposed on the high-pressure groove 45 which forms a circular arc with a substended angle less than 170 degress in the compression side of the compressor. A plurality of high-pressure passage 46 extend axially from the high-pressure groove 45 into the center housing 22. A single air-return passage 56 is disposed on the low-pressure groove 55 and connected through the air-return groove 57 to the air-bearing room 40 defined between the inner periphery of the center housing 22 and the outer periphery of the rotary sleeve 30. Four vanes 16 are fitted in the vane grooves 15 to confine the both compression and suction working spaces 43, 53 in the respective compression and suction sides together with the outer surface of the rotor 10 and the inner surface of the rotary sleeve 30. Four bolts 27 are circularly equidistantly disposed in the thickened portions 28 of the center housing 22.

In operation, the rotation of engine is transmitted to the rotor 10 by the pulley 14. As the rotor 10 rotates, air is taken into the suction working space 53 from the suction chamber 51 and then compressed in the compression working space 43 from which the compressed air is delivered to discharge chamber 41. A part of the compressed air in the discharge chamber 41 is led to high-pressure passage 46 through high-pressure hole 44 and high-pressure groove 45 and then injected into the air-bearing room 40 through throttles 47 axially symmetrically disposed in the compression side inner periphery of the center housing 22. The injected air forms a static air-bearing to prevent the rotary sleeve 30 from contacting the inner periphery of the center housing 22. Then, the air flows stably symmetrically from the compression side to the suction side of the air-bearing room 40 to produce a dynamic pressure to floatingly support the rotary sleeve 30. This means that the static and dynamic pressure of the injected air not only pushes back the rotary sleeve 30 when the compressed air in the compression working space 43 puts aside the rotary sleeve toward the compression side inner periphery of the center housing 22 but also increases the bearing capacity of the air-bearing room 40. Thereafter, the air radially symmetrically enters the front and rear air-return grooves 57 and flows out to the open air through the air-return passage 56 and a vent 50 or returns to the suction chamber 51 through the low-pressure groove 55 and the low-pressure hole 54.

Figure 5:
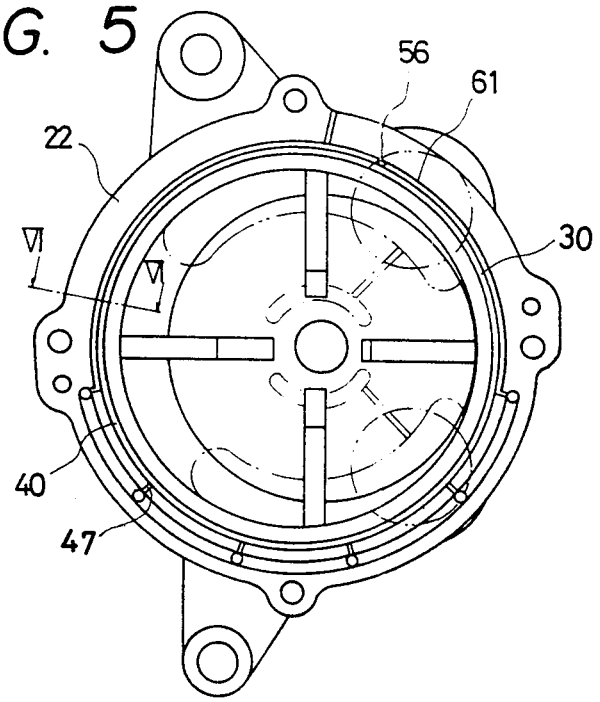
FIG. 5 is a section of another embodiment, similar to FIG. 3.
Figure 6:
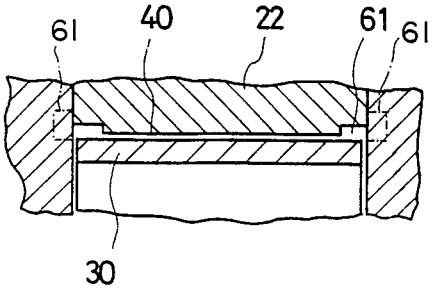
FIG. 6 is a section taken along the line VI—VI of FIG. 5.
Figure 8:
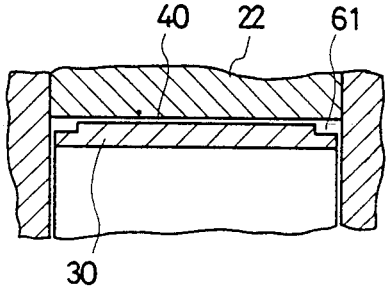
FIGS. 8 and 9 are sections of still further embodiments, similar to FIG. 6.
Figure 7:
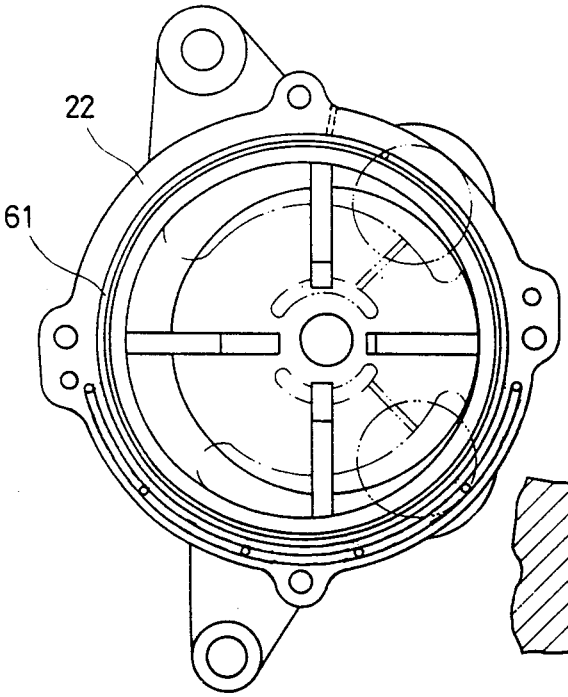
FIG. 7 is a section of a further embodiment, similar to FIG. 3.
Figure 9:
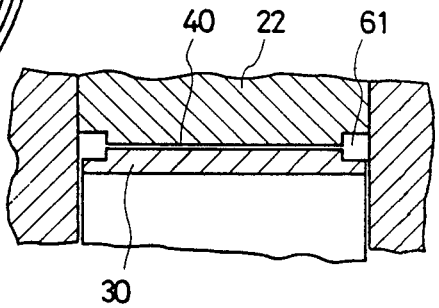

The high-pressure hole 44 can be connected diectly to discharge port 42 without the intervention of discharge valve 60. High-pressure and low-pressure grooves 45, 55 can be formed in either or both of the center housing 22 and the front and rear side housings 21, 23. As seen in FIGS. 5 and 6, the center housing 22 is formed at its inner opposite sides with the both air-return grooves 61 which forms a semicircular arc in the suction side of the center housing 22. The air return grooves 61 can also be formed in the inner side surfaces of the front and rear side housings, in place of or together with the air-return grooves in the center housing, as shown by dotted lines of FIG. 6. The both air-return grooves 61 intersect the air-return hole 56. The air is injected through the throttles 47 into the air-bearing room 40 between the rotary sleeve 30 and the center housing 22 to rapidly flow to the air-return hole 56 through the air-return grooves 61 and produce a dynamic pressure. As seen in FIG. 7, the air-return groove 61 is not limited to be semicircular but can be fully circularly formed in the opposite sides of the center housing 22. As seen in FIGS. 8 and 9. the air-return groove 61 can be provided in either or both of the both outer side of the rotary sleeve 30 and the center housing 22 to produce a smooth air-flowing in the air-bearing room 40 and increase an air-bearing effect.

What is claimed is:

1. A rotary compressor comprising a center housing and front and rear side housings, a rotary sleeve mounted for rotation in said center housing, a rotor eccentrically disposed in said rotary sleeve, said rotor having a plurality of vanes radially, movably fitted therein, an air-bearing room disposed between the inner periphery of said center housing and the outer periphery of said rotary sleeve, and a pair of discharge and suction chambers, said compressor comprising at least one high-pressure passage formed in the compression side of said center housing and internally connected to air compressed in said rotary compressor, and a plurality of throttles communicating with the compression side, inner periphery of said center housing from said high-pressure passage, said high pressure passage forming a circular arc having a subtended angle of less than 170 degrees, whereby said air-bearing room is supplied with air compressed in said rotary compressor to floatingly support said rotary sleeve.

2. The rotary compressor as claimed in claim 1, wherein said high-pressure passage is internally connected to said discharge chamber through a high-pressure groove formed in said center housing to cross said high-pressure passage and a high-pressure hole extending from said discharge chamber to said high-pressure groove.

3. The rotary compressor as claimed in claim 1, wherein said high-pressure passage is internally connected to said discharge chamber through a high-pressure groove formed in at least one of said front and rear side housings to cross said high-pressure passage and a high-pressure hole extending from said discharge chamber to said high-pressure groove.

4. The rotary compressor as claimed in claim 1, wherein said high-pressure passage is internally connected to said discharge chamber through a high-pressure groove formed in both of said center housing and at least one of said side housings to cross said high-pressure passage and a high-pressure hole extending from said discharge chamber to said high-pressure groove.

5. The rotary compressor as claimed in claim 1, wherein said air-bearing room is internally connected to said suction chamber through a pair of front and rear air-return grooves formed in the opposite side surfaces of said center housing, an air-return passage passing through the suction side of said center housing to cross said air-return grooves, and a low-pressure hole formed in one of said front and rear side housings to connect said low-pressure groove to said suction chamber.

6. The rotary compressor as claimed in claim 5, wherein said air-return passage is branched to communicate with the atmosphere.

7. The rotary compressor as claimed in claim 5, wherein said air-return groove is annularly formed at least in the suction side of both sides of the inner periphery of said center housing and opened to said air-bearing room.

8. The rotary compressor as claimed in claim 5, wherein said air-return groove is circularly formed in both sides of the inner periphery of said center housing and communicates with said air-bearing room.

9. The rotary compressor as claimed in claim 5, wherein said air-return groove is formed in the inner surface of each of said front and rear side housings and communicates with air-bearing room.

10. The rotary compressor as claimed in claim 5, wherein said air-return groove is circularly formed in both sides of the outer periphery of said rotary sleeve and communicates with said air-bearing room.

11. The rotary compressor as claimed in claim 5, wherein said air-return groove is circularly formed in both sides of the inner periphery of said center housing and the outer periphery of said rotary sleeve and communicates with said air-bearing room.

12. The rotary compressor as claimed in claim 5, wherein said air-return groove is formed in the side surface of said center housing and communicates with said air-bearing room.

13. The rotary compressor as claimed in claim 5, wherein said air-return groove is formed in both of the inner surface of each of said front and rear side housings and the side surface of said center housing and communicates with said air-bearing room.

* * * * *